US006729979B1

(12) United States Patent
Sullivan

(10) Patent No.: US 6,729,979 B1
(45) Date of Patent: May 4, 2004

(54) BASKETBALL SHOOTING TRAINER DEVICE

(75) Inventor: Timothy D. Sullivan, Batavia, NY (US)

(73) Assignees: Donald E. Gugel, Batavia, NY (US); Randolph P. Zickl, Batavia, NY (US)

( * ) Notice: Subject to any disclaimer, the term of this patent is extended or adjusted under 35 U.S.C. 154(b) by 0 days.

(21) Appl. No.: 10/161,669

(22) Filed: Jun. 4, 2002

(51) Int. Cl.[7] ..... A63B 69/00

(52) U.S. Cl. ..... 473/450; 473/61; D29/113; 2/163; 2/161.1

(58) Field of Search ..... 473/450, 447, 473/446, 422, FOR 101, 61; D29/113; 2/161.1, 163

(56) References Cited

U.S. PATENT DOCUMENTS 5,636,381 A * 6/1997 Brogden ..... 2/161.1

* cited by examiner

*Primary Examiner*—Gregory Vidovich
*Assistant Examiner*—M. Chambers

(57) ABSTRACT

A basketball shooting trainer device for teaching a user to correctly shoot and release a basketball. The basketball shooting trainer device includes a piece of material having a top edge and a bottom edge and being adapted to removably cover a back of a user's basketball shooting hand; and also includes tubular finger members extending from the top edge of the piece of material and being adapted to fittingly receive a user's fingers; and further includes a finger wedge being attached to the piece of material for keeping a user's middle two fingers spread apart; and also includes a support member being attached to the piece of material; and also includes a strap assembly being attached along the bottom edge of the piece of material and being adapted to removably fasten about a user's wrist to support the piece of material upon the user's basketball shooting hand.

2 Claims, 3 Drawing Sheets

BASKETBALL SHOOTING TRAINER DEVICE

BACKGROUND OF THE INVENTION

1. Field of the Invention

The present invention relates to basketball shooting trainers and more particularly pertains to a new basketball shooting trainer device for teaching a user to correctly shoot and release a basketball.

2. Description of the Prior Art

The use of basketball shooting trainers is known in the prior art. More specifically, basketball shooting trainers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,738,447; U.S. Pat. No. 3,707,730; U.S. Pat. No. 5,500,956; U.S. Pat. No. 5,833,233; U.S. Pat. No. 5,692,242; and U.S. Pat. No. Des. 349,365.

While these devices fulfill their respective, particular objectives and requirements, the aforementioned patents do not disclose a new basketball shooting trainer device. Te prior art describes inventions including gloves being worn for batting, golfing, and bowling.

SUMMARY OF THE INVENTION

The general purpose of the present invention, which will be described subsequently in greater detail, is to provide a new basketball shooting trainer device which has many of the advantages of the basketball shooting trainers mentioned heretofore and many novel features that result in a new basketball shooting trainer device which is not anticipated, rendered obvious, suggested, or even implied by any of the prior art basketball shooting trainers, either alone or in any combination thereof. The present invention includes a piece of material having a top edge and a bottom edge and being adapted to removably cover a back of a user's basketball shooting hand; and also includes tubular finger members extending from the top edge of the piece of material and being adapted to fittingly receive a user's fingers; and further includes a finger wedge being attached to the piece of material for keeping a user's middle two fingers spread apart; and also includes a support member being attached to the piece of material; and also includes a strap assembly being attached along the bottom edge of the piece of material and being adapted to removably fasten about a user's wrist to support the piece of material upon the user's basketball shooting hand. None of the prior art includes the elements of the present invention.

There has thus been outlined, rather broadly, the more important features of the basketball shooting trainer device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new basketball shooting trainer device which has many of the advantages of the basketball shooting trainers mentioned heretofore and many novel features that result in a new basketball shooting trainer device which is not anticipated, rendered obvious, suggested, or even implied by any of the prior art basketball shooting trainers, either alone or in any combination thereof.

Still another object of the present invention is to provide a new basketball shooting trainer device for teaching a user to correctly shoot and release a basketball.

Still yet another object of the present invention is to provide a new basketball shooting trainer device that is easy and convenient to wear upon one's shooting hand.

Even still another object of the present invention is to provide a new basketball shooting trainer device that prevents a user from twisting one's wrist and bending one's fingers as the user releases the basketball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
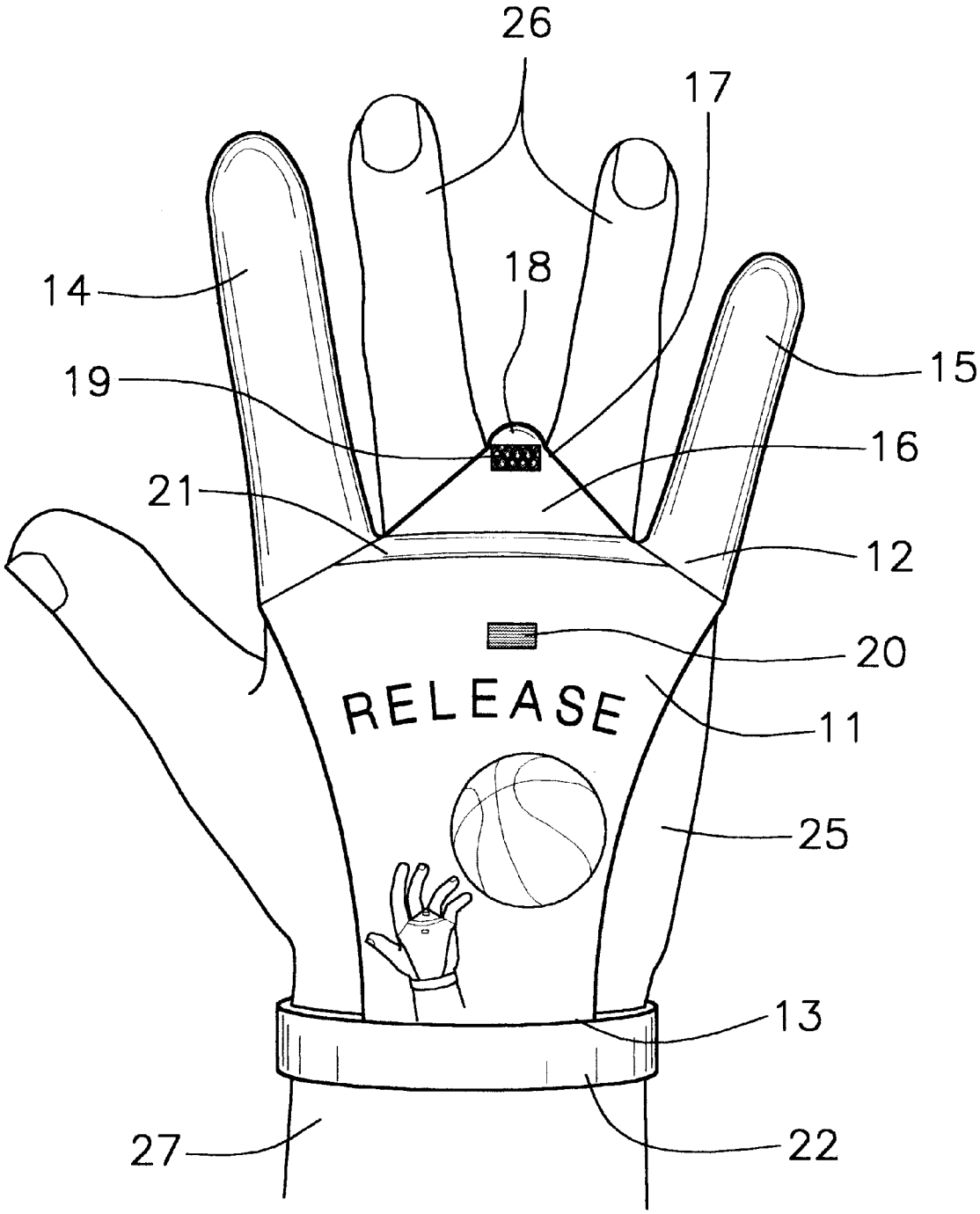
FIG. 1 is a back elevational view of a new basketball shooting trainer device according to the present invention and shown in use.
Figure 2:
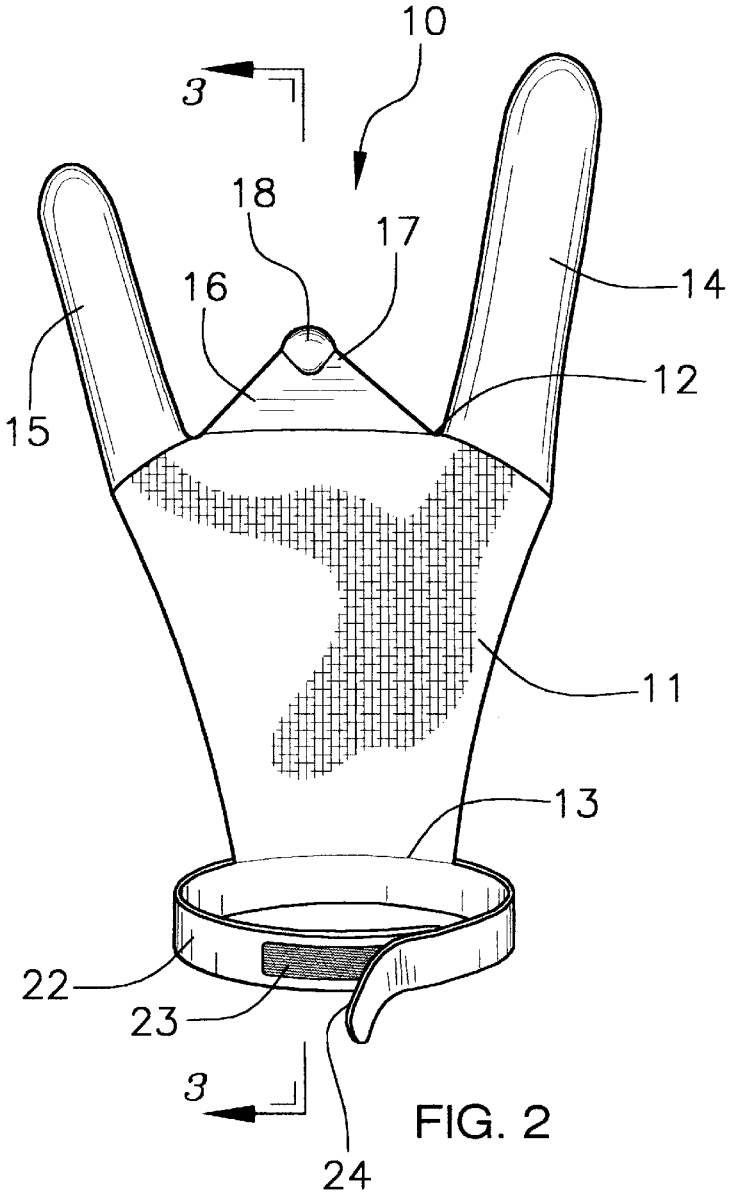
FIG. 2 is a front elevational view of the present invention.
Figure 3:
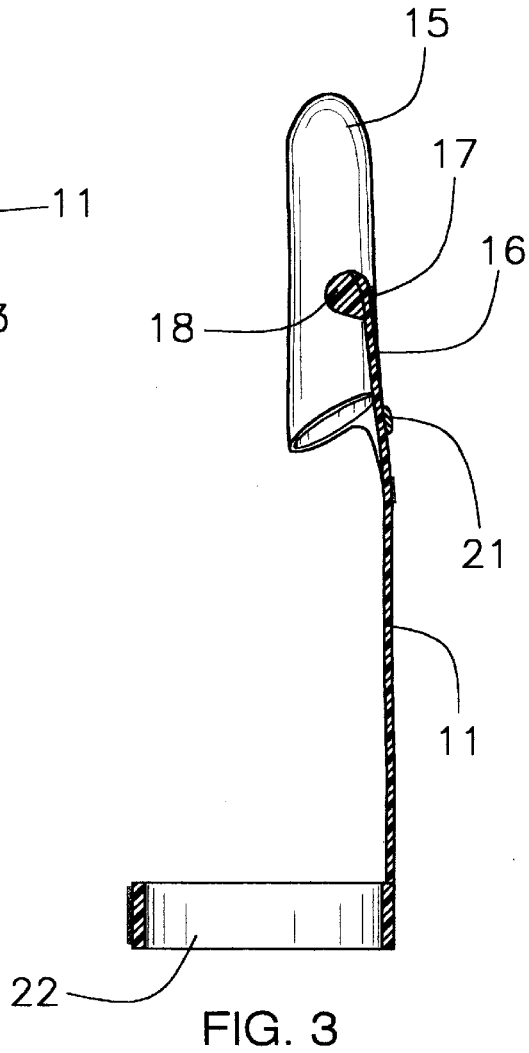
FIG. 3 is a side elevational of the present invention.
Figure 4:
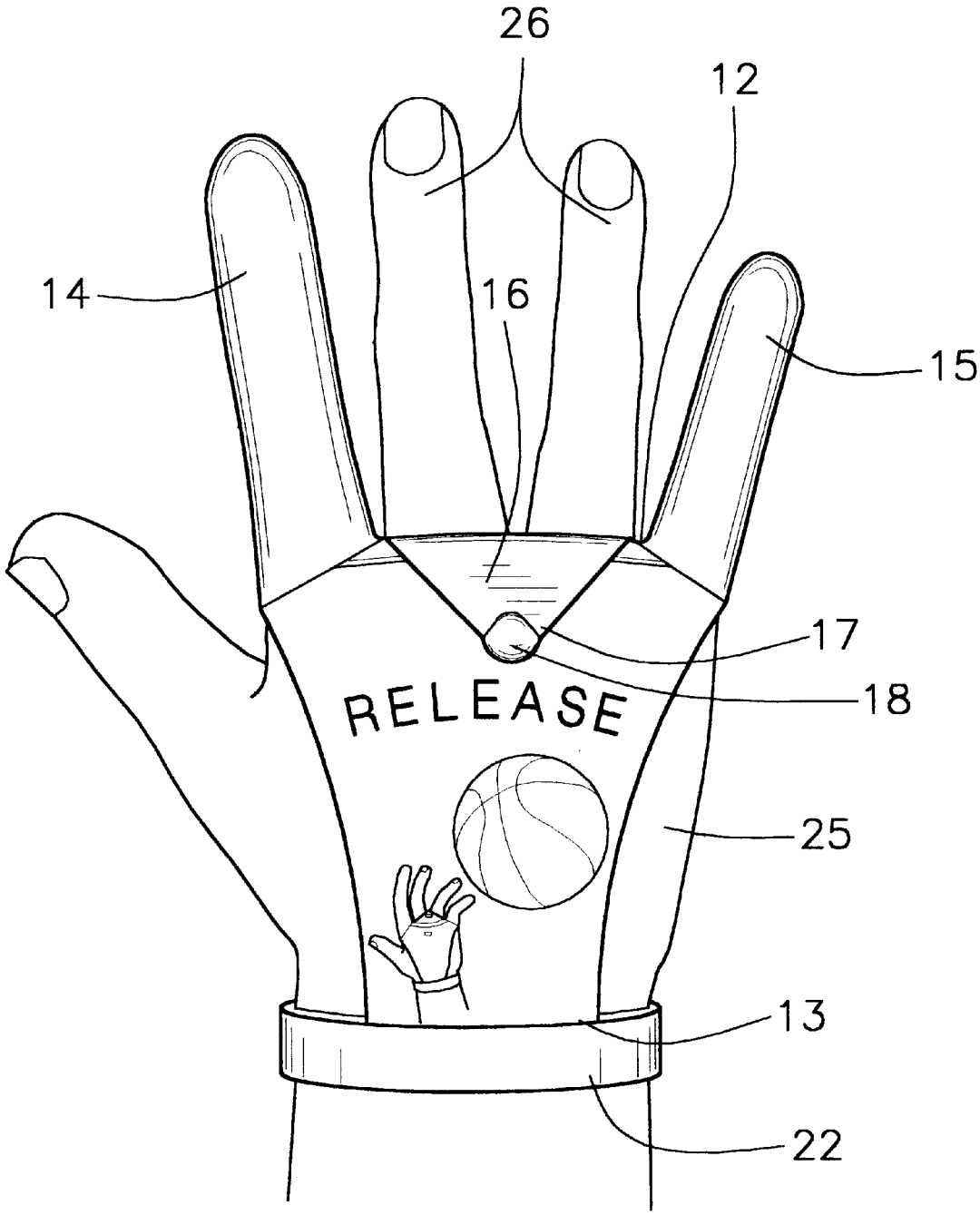
FIG. 4 is another back elevational view of the present invention.

With reference now to the drawings, and in particular to FIGS. 1 through 4 thereof, a new basketball shooting trainer device embodying the principles and concepts of the present invention and generally designated by the reference numeral 10 will be described.

As best illustrated in FIGS. 1 through 4, the basketball shooting trainer device 10 generally comprises a piece of material 11 having a top edge 12 and a bottom edge 13 and being adapted to removably cover a back of a user's basketball shooting hand 25. The piece of material 11 is stretchable and is tapered from the top edge 12 to the bottom edge 13.

Tubular finger members 14,15 extend from the top edge 12 of the piece of material 11 and are adapted to fittingly receive a user's fingers. The tubular finger members 14,15 include an index tubular finger member 14 being integrally attached at one end of the top edge 12 of the piece of material 11 for receiving a user's index finger, and also include a pinky tubular finger member 15 being integrally attached to the other end of the top edge 12 of the piece of material 11 and being separated from the index tubular finger member 14 for receiving a user's pinky finger.

A finger wedge is conventionally attached to the piece of material 11 for keeping a user's middle two fingers 26 spread apart. The finger wedge includes a triangular-shaped flap 16 being integrally attached along the top edge 12 of the piece of material 11 between the index and pinky tubular finger members 14,15, and also includes a wad member 18 being conventionally attached upon a front side and at a vertex tip 17 of the triangular-shaped flap 16 for spreading apart the user's two middle fingers 26, and further includes a first strip of hook and loop fasteners 19 being conventionally attached upon the back side and at the vertex tip 17 of the triangular-shaped flap 16 and being attachable to a second strip of hook and loop fasteners 20 which is securely and conventionally attached upon a back side of the piece of material 11 when the finger wedge is not being used.

A support member 21 is conventionally attached to the piece of material 11. The support member is a rib 21 being conventionally attached to the back side of the piece of material 11 and being extended from the index tubular finger member 14 to the pinky tubular finger member 15.

A strap assembly is conventionally attached along the bottom edge 13 of the piece of material 11 and being adapted to removably fasten about a user's wrist 27 to support the piece of material 11 upon the user's basketball shooting hand. The strap assembly includes a strap 22 being securely and conventionally attached along the bottom edge 13 of the piece of material 11 and also includes strips of hook and loop fastener members 23,24 being securely and conventionally attached at ends of the strap 22 and being fastenable together for fastening the strap 22 about the user's wrist 27.

In use, the user unfastens the triangular-shaped flap 16 which springs outwardly from the piece of material 11 between the user's two middle fingers 26 with the wad member 18 making sure that the user's two middle fingers 26 are spread apart. Due to the tension of the piece of material 11 and the tubular finger members 14,15, the user's shooting hand is held in a stable position, and the user must flick one's wrist in order to correctly release the basketball.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the basketball shooting trainer device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A basketball shooting trainer device comprising:

a piece of material having a top edge and a bottom edge and being adapted to removably cover a back of a user's basketball shooting hand, said piece of material being stretchable and being tapered from said top edge to said bottom edge;

tubular finger members extending from said top edge of said piece of material and being adapted to fittingly receive a user's fingers, said tubular finger members including an index tubular finger member being integrally attached at one end of said top edge of said piece of material for receiving a user's index finger, and also including a pinky tubular finger member being integrally attached to the other end of said top edge of said piece of material and being separated from said index tubular finger member for receiving a user's pinky finger;

a finger wedge being attached to said piece of material for keeping a user's middle two fingers spread apart, said finger wedge including a triangular-shaped flap being integrally attached along said top edge of said piece of material between said index and pinky tubular finger members, and also including a wad member being attached upon a front side and at a vertex tip of said triangular-shaped flap for spreading apart the user's two middle fingers, and further including a first strip of hook and loop fasteners being attached upon said back side and at said vertex tip of said triangular-shaped flap and being attachable to a second strip of hook and loop fasteners which is securely attached upon a back side of said piece of material when said finger wedge is not being used;

a support member being attached to said piece of material; and a strap assembly being attached along said bottom edge of said piece of material and being adapted to removably fasten about a user's wrist to support said piece of material upon the user's basketball shooting hand.

2. A basketball shooting trainer device comprising:

a piece of material having a top edge and a bottom edge and being adapted to removably cover a back of a user's basketball shooting hand, said piece of material being stretchable and being tapered from said top edge to said bottom edge;

tubular finger members extending from said top edge of said piece of material and being adapted to fittingly receive a user's fingers, said tubular finger members including an index tubular finger member being integrally attached at one end of said top edge of said piece of material for receiving a user's index finger, and also including a pinky tubular finger member being integrally attached to the other end of said top edge of said piece of material and being separated from said index tubular finger member for receiving a user's pinky finger;

a finger wedge being attached to said piece of material for keeping a user's middle two fingers spread apart;

a support member being attached to said piece of material, said support member is a rib being attached to said back side of said piece of material and being extended from said index tubular finger member to said pinky tubular finger member; and a strap assembly being attached along said bottom edge of said piece of material and being adapted to removably fasten about a user's wrist to support said piece of material upon the user's basketball shooting hand.

* * * * *